US006399863B2

(12) United States Patent
Madeley

(10) Patent No.: US 6,399,863 B2
(45) Date of Patent: Jun. 4, 2002

(54) MUSICAL INSTRUMENT

(75) Inventor: Ian Madeley, Watlington (GB)

(73) Assignee: Logistix Limited (GB)

( * ) Notice: Subject to any disclaimer, the term of this patent is extended or adjusted under 35 U.S.C. 154(b) by 0 days.

(21) Appl. No.: 09/972,359

(22) Filed: Oct. 3, 2001

Related U.S. Application Data

(63) Continuation of application No. 29/137,229, filed on Feb. 15, 2001, which is a continuation of application No. 29/107,133, filed on Jun. 28, 1999, now abandoned.

(30) Foreign Application Priority Data

Dec. 24, 1998 (GB) ..... 2080041

(51) Int. Cl.[7] ..... E10D 7/00

(52) U.S. Cl. ..... 84/380 R; 84/330; 84/331; 84/335

(58) Field of Search ..... 84/330, 331, 335, 84/380 R, 336, 377, 378, 351, 402; 446/128

(56) References Cited

U.S. PATENT DOCUMENTS

| | | | | | |
|---|---|---|---|---|---|
| 780,674 | A | | 1/1905 | Leech | |
| 1,197,251 | A | * | 9/1916 | Austin | 84/331 |
| 59,323 | A | | 10/1921 | Bartolowsky | |
| 1,631,862 | A | * | 6/1927 | Hansell | 84/330 |
| 2,167,582 | A | * | 7/1939 | McCord | 84/330 |
| D158,172 | S | | 4/1950 | Berk | |
| D172,134 | S | | 5/1954 | Del Mas | |
| 2,782,557 | A | * | 2/1957 | Harley | 46/180 |
| 3,766,683 | A | * | 10/1973 | Vennola | 46/17 |
| D266,652 | S | | 10/1982 | Nagel | |
| 4,970,931 | A | | 11/1990 | Culbreath | |
| D360,904 | S | | 8/1995 | Schilling | |
| D385,819 | S | | 11/1997 | Chen | |
| 6,342,662 | B1 | * | 1/2002 | Chang | 84/402 |

FOREIGN PATENT DOCUMENTS

| | | | | |
|---|---|---|---|---|
| FR | 112575 | * | 4/1876 | 84/330 |
| GB | 2080041 | | 12/1998 | |

OTHER PUBLICATIONS

Ukrainian Folk Wind Instruments www.bandura.ca/VM-folkbook/wind, Feb. 19, 2002.*

* cited by examiner

*Primary Examiner*—Robert E. Nappi
*Assistant Examiner*—Kim Lockett
(74) *Attorney, Agent, or Firm*—Stetina Brunda Garred & Brucker

(57) ABSTRACT

There is provided a musical instrument comprising a plurality of elongated tubular members operative to generate specific sounds when blown therethrough. Each instrument body also has two opposing sides having a first radially extending female connector and a second musical instrument male connector, whereby the plurality of tubular members may be maintained in a generally parallel axis assembly.

14 Claims, 2 Drawing Sheets

Fig. 3
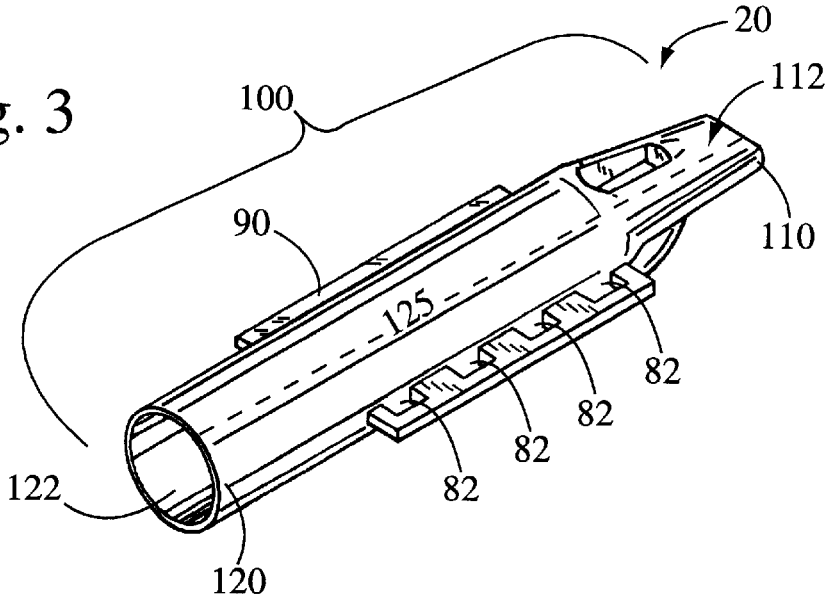
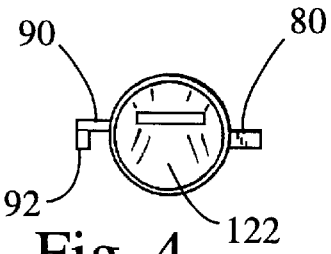
Fig. 4
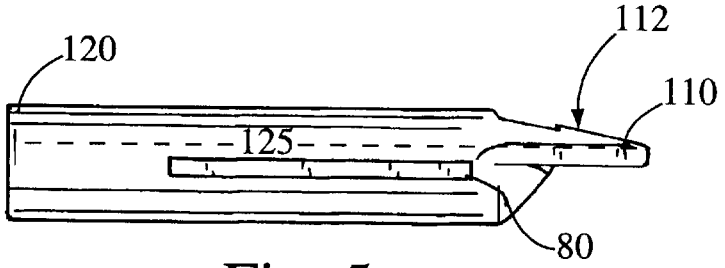
Fig. 5
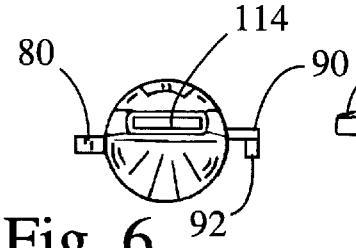
Fig. 6
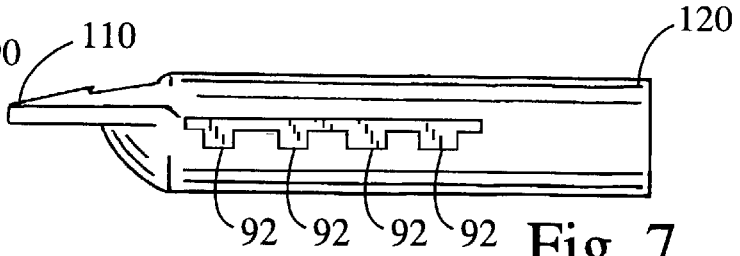
Fig. 7
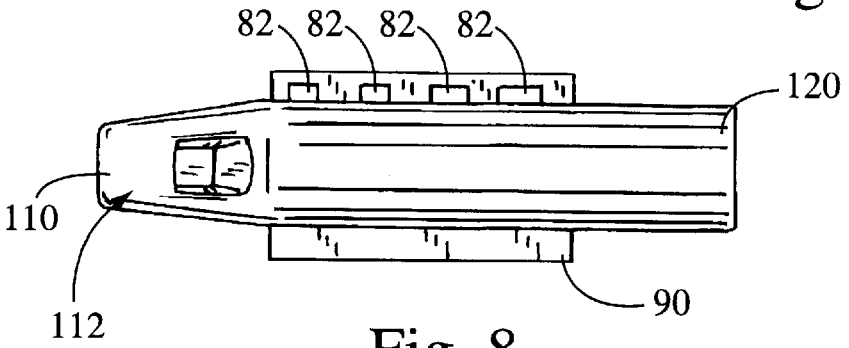
Fig. 8

MUSICAL INSTRUMENT

CROSS-REFERENCE TO RELATED APPLICATIONS

The present application is a continuation application of pending U.S. Design Application Ser. No. 29/137,229 filed Feb. 15, 2001 entitled MUSICAL INSTRUMENT, which is a continuation application of U.S. Design Patent Application Ser. No. 29/107,133 entitled MUSICAL INSTRUMENT filed Jun. 28, 1999 now abandoned, the disclosure of which is expressly incorporated herein by reference.

STATEMENT RE: FEDERALLY SPONSORED RESEARCH/DEVELOPMENT (Not Applicable)

BACKGROUND OF THE INVENTION

The present invention relates generally to a musical instrument, and more particularly to an improved musical instrument that may be connected to a plurality of similarly configured musical instruments to form a musical instrument system operative to generate varying musical sounds.

The use of a musical instrument to generate a sound is well known. Many different types of musical instruments may be utilized to generate various kinds of sound. For instance, harmonicas, saxophones and bugles are examples of musical wind instruments that use the passage of airflow therethrough for forming sound.

As is well known, most wind instruments, such as bugles, harmonicas, saxophones, or the like, are constructed in a way to play different notes. However, there exist many lower cost musical instruments that are not capable of providing multiple notes.

Musical instruments that are not capable of generating the different notes, for instance musical whistles, are usually marked by a single frequency, i.e., one-note generating characteristic. A user of such musical whistle instruments have heretofor been required to buy a plurality of instruments for achieving various musical notes. Moreover, the user has heretofor been required to individually pick-up and lay-down each of such whistles when generating the specific sound corresponding thereto.

Thus, there exists a need for an improved musical whistle instrument system that allows the user to play various sound generating musical instruments without picking-up and putting-down individual whistle instruments.

BRIEF SUMMARY OF THE INVENTION

The present invention specifically addresses and overcomes the above-described deficiency of prior art musical whistle instruments by providing a connectable mechanism thereto for forming a musical whistle instrument system. More specifically, each musical whistle instrument of the present invention includes a female connector and a male connector on opposite sides thereof. The female connector may comprise a plurality of apertures for receiving a plurality of corresponding male connector protrusions of the adjacent instrument. In this respect, not only does the present invention mitigate the need to individually pick-up and lay-down one whistle instrument at a time when playing a musical song, but it also minimizes the risk of losing such instruments as well.

The musical instrument system of the present invention comprises one or more elongated tubular member each operative to generate a specific sound when blown therethrough. Opposing sides of the tubular members are provided with complimentary formed flanges which may be utilized to selectively connect adjacent tubular members together in a side by side coaxial configuration.

BRIEF DESCRIPTION OF THE DRAWINGS

These as well as other features of the present invention will become more apparent upon reference to the drawings wherein:

FIG. 3 is a top perspective view of a musical instrument according to a second embodiment;

FIG. 4 is a bottom plan view thereof;

FIG. 5 is a left side elevational view thereof;

FIG. 6 is a top plan view thereof;

FIG. 7 is a right side elevational view thereof; and

FIG. 8 is a bottom perspective view thereof.

DETAILED DESCRIPTION OF THE INVENTION

Figure 1:
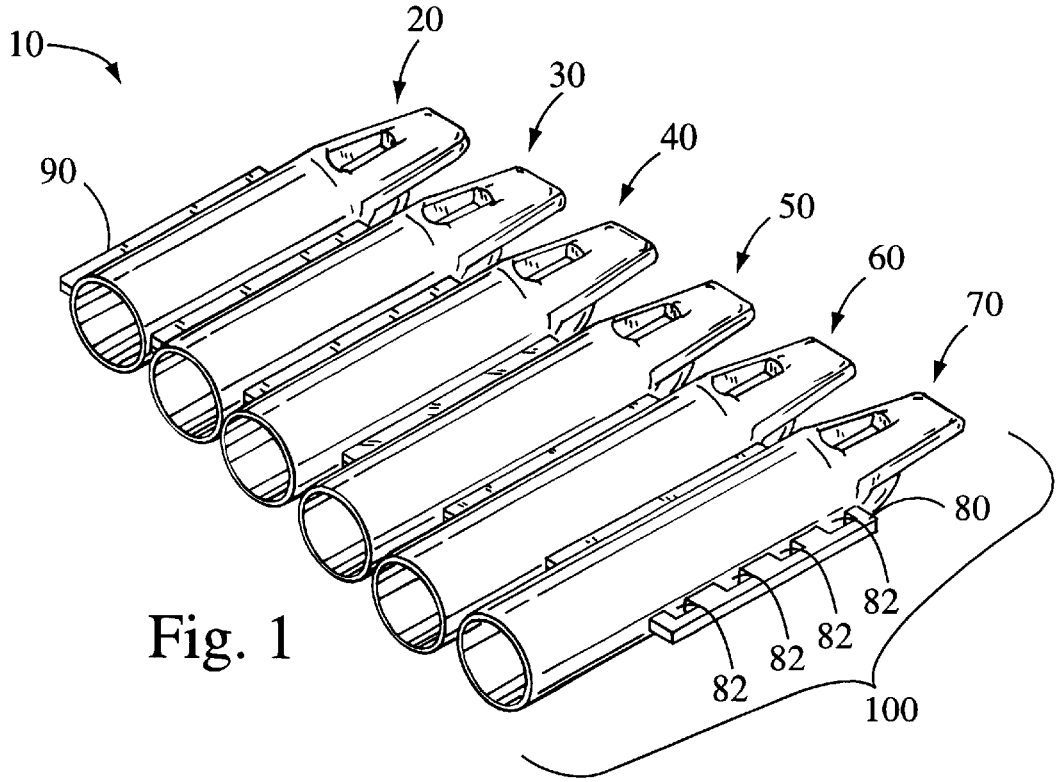
FIG. 1 is a top perspective view of a musical instrument system of the present invention.

Referring now to the drawings wherein the showings are for purposes of illustrating preferred embodiments of the present invention only, and not for purposes of limiting the same. FIG. 1 illustrates the musical whistle instrument 10 of the present invention. The musical whistle instrument 10 is comprised of six elongated tubular members 20, 30, 40, 50, 60, 70 each operative to generate a specific sound when blown therethrough. As depicted, each of the six elongated tubular members 20, 30, 40, 50, 60, 70 includes complimentary formed flanges 80, 90 which may be used to connect adjacent tubular members 20, 30, 40, 50, 60, 70 together in a side by side parallel axis configuration.

Figure 2:
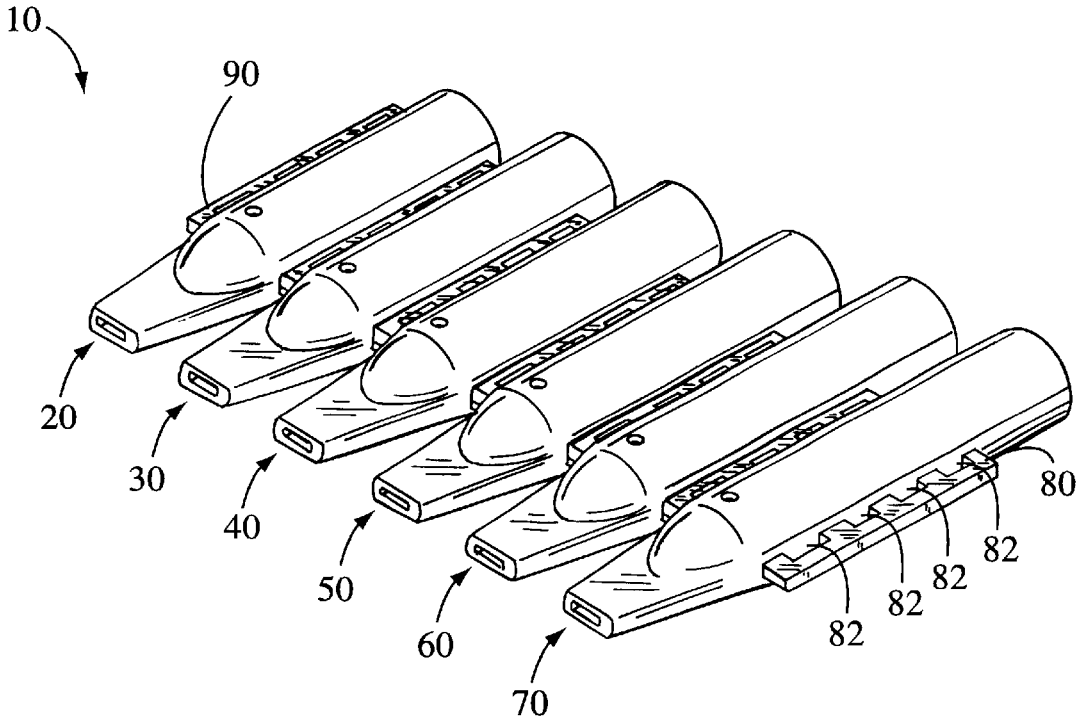
FIG. 2 is a bottom perspective view thereof.

Referring particularly to FIGS. 1 and 2, the six elongated tubular members 20, 30, 40, 50, 60, 70 are formed having differing axial lengths 100. The varying axial lengths 100 between the tubular members 20, 30, 40, 50, 60, 70 is configured to produce multiple sound frequencies. Thus, by arranging the six tubular members 20, 30, 40, 50, 60, 70 in a side by side parallel axis configuration, multiple sound frequencies can be generated when selectively blown therethrough.

With the exception of their differing axial lengths 100, the tubular members 20, 30, 40, 50, 60, 70 are similarly formed as to their structure. In this regard, a description of one elongated tubular member may serve as an exemplary illustration for the remaining tubular members. Therefore, the applicant will describe one elongated tubular member 20 in detail which may be applicable to the other five remaining tubular members 30, 40, 50, 60, 70.

Referring now to FIGS. 3, 4 and 6, the elongated tubular member 20 comprises a first end 110 which forms a mouthpiece 112. Adjacent the mouthpiece 112, there is provided a whistle opening 114 which may be blown through for the purpose of generating sounds. Opposite to the first end 110, the tubular member 20 further defines a second end 120 which forms an exit opening 122. In addition, there is an internal cavity 125 that extends along the axial length 100 between the whistle and exit openings 114, 122 for the purpose of providing fluid communication therebetween.

Referring now to FIGS. 5, 7 and 8, the elongated tubular member 20 defines two opposing sides 130, 140. Formed on respective ones of the opposing sides 130, 140, there is provided first and second radially extending flanges 80, 90, with flange 80 forming a female connector and flange 90 forming a male connector.

The female connector 80 is removably connectable to a male connector 90 of adjacent tubular members 30, 40, 50, 60 or 70. The female connector 80 defines a plurality of apertures 82 extending therethrough. The plurality of apertures 82 of the female connector 80 are adapted to receive complementary sized corresponding protrusions 92 formed on the male connector 90.

As shown, the protrusions 92 extend in a downward direction from the male connector 90 to form a generally perpendicular relationship thereto. The protrusions 92 are sized to enter through the corresponding apertures 82 of the female connector formed on adjacent tubular members 30, 40, 50, 60 or 70 for engagement thereto.

The musical whistle instrument system 10 of the present invention is formed by positioning the tubular members 20, 30, 40, 50, 60, 70 in a side by side parallel axis orientation and connecting each respective female connectors 80 thereof with the adjacent male connectors 90.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A musical instrument comprising:

an elongated tubular member operative to generate a specific sound when blown therethrough, the elongated tubular member having two opposing sides thereof;

first and second radially extending flanges formed on respective ones of the opposing sides of the elongated tubular member; and wherein the first radially extending flange is a female connector connectable to a second musical instrument male connector, the second radially extending flange is a male connector connectable to a third musical instrument female connector.

2. The instrument of claim 1 wherein the elongated tubular member has a first end forming a mouthpiece, the elongated tubular member further including a whistle opening formed adjacent the mouthpiece.

3. The instrument of claim 2 wherein the elongated member has a second end forming an exit opening, the elongated tubular member further defining an internal cavity between the whistle opening and the exit opening to provide fluid communication therebetween.

4. The instrument of claim 1 wherein the female connector comprises a plurality of apertures, the apertures being complimentary shaped to the second musical instrument male connector, the apertures being receivable of the second musical instrument male connector therethrough.

5. The instrument of claim 4 wherein the female connector defines four apertures.

6. The instrument of claim 1 wherein the male connector comprises a plurality of protrusions extending downward in generally perpendicular relationship thereto, the protrusions being complimentary shaped to the third musical instrument female connector for engagement thereto.

7. The instrument of claim 6 wherein the male connector defines four protrusions.

8. A musical instrument system comprising:

a plurality of elongated tubular members, each respective one of the plurality of elongated tubular members being operative to generate a specific sound when blown therethrough, the elongated tubular members each having two opposing sides thereof;

a plurality of first and second radially extending flanges, the first and second radially extending flanges each being formed on respective ones of the opposing sides of respective ones of the elongated tubular members; and wherein the first radially extending flanges are female connectors, the second radially extending flanges are male connectors, the female and male connectors are connectable to each other to form the musical instrument system.

9. The system of claim 8 wherein the elongated tubular members comprise six elongated tubular members.

10. The system of claim 8 wherein the elongated tubular members each has an axial length, the length of each respective one of the elongated tubular members being different from each other to produce a frequency corresponding to the specific sound generated therefrom.

11. The system of claim 8 wherein each respective one of the female connectors comprise a plurality of apertures, each respective one of the apertures being complimentary shaped to each respective one of the male connectors, each respective one of the apertures being receivable of one of the male connectors therethrough.

12. The instrument of claim 11 wherein each respective one of the female connectors defines four apertures.

13. The instrument of claim 8 wherein each respective one of the male connectors comprises a plurality of protrusions extending downward in generally perpendicular relationship thereto, each respective one of the protrusions being complimentary shaped to each respective one of the female connectors for engagement thereto.

14. The instrument of the claim 13 wherein each respective one of the male connectors defines four protrusions.

* * * * *